United States Patent [19]

Martinez Sanz et al.

[11] Patent Number: 5,026,035

[45] Date of Patent: Jun. 25, 1991

[54] PAPER HANDLING APPARATUS

[75] Inventors: Jose A. Martinez Sanz, Barcelona, Spain; Rex M. K. Gough, Cambridge, United Kingdom

[73] Assignee: Pitney Bowes plc, Harlow, England

[21] Appl. No.: 334,964

[22] Filed: Apr. 7, 1989

[30] Foreign Application Priority Data

Apr. 8, 1988 [GB] United Kingdom ..... 8808313
May 6, 1988 [GB] United Kingdom ..... 8810699

[51] Int. Cl.[5] ..... B42C 1/00

[52] U.S. Cl. ..... 270/45; 270/56; 271/262; 493/25; 493/27

[58] Field of Search ..... 270/32, 45, 48, 56; 493/8, 10, 13, 14, 25, 27, 419, 420; 271/258–262

[56] References Cited

U.S. PATENT DOCUMENTS 2,728,178 12/1955 Kern ..... 270/45
3,191,925 6/1965 McCain ..... 270/56
3,416,785 12/1968 Sherman ..... 270/45
3,664,665 5/1972 McCain ..... 270/56
4,101,121 7/1978 Rastorguyeff ..... 493/420
4,132,402 1/1979 Morrison ..... 270/56
4,560,159 12/1985 Staub ..... 270/56

FOREIGN PATENT DOCUMENTS 3014473 10/1981 Fed. Rep. of Germany ..... 493/420

*Primary Examiner*—Edward K. Look
*Assistant Examiner*—Therese M. Newholm
*Attorney, Agent, or Firm*—Robert E. Meyer; David E. Pitchenik; Melvin J. Scolnick

[57] ABSTRACT

A folder inserter machine includes a device for monitoring the passage of stationery items between a pair of feed rollers (32, 38). A first signal is output if a single item is between the rollers and a second signal is output if more than one item is between the rollers. in the illustrated embodiment the first signal indicates to the folder inserter control that the machine is ready to accept a second insert and the second signal indicates that a multiple feed has occurred and flags a warning to the operator.

5 Claims, 5 Drawing Sheets

PAPER HANDLING APPARATUS

FIELD OF THE INVENTION

This invention relates to paper handling apparatus and, in particular, but not exclusively, to folder inserter machines.

BACKGROUND OF THE INVENTION

Examples of earlier proposed table top folder inserters which can be used in an automatic mode, arrangements are disclosed in U.S. Pat. No. 4,471,598 and U.K. Patent No. 2183214.

SUMMARY OF THE INVENTION

The applicants have designed a paper handling apparatus which incorporates a sensing mechanism for monitoring the passage of stationery items between a pair of feed rollers and which outputs different signals dependent on whether a single item is fed or more than one item is fed.

According to this invention, there is provided paper handling apparatus including a paper path, two feed rollers in driving association located on said paper path and movement sensor means for detecting separating movement of said feed rollers, said sensor being operable to output a first signal in response to the presence of a single stationery item between said feed rollers and to output a second signal when more than one stationery item passes between said feed rollers, whereby in use passage of a single item between said feed rollers causes said first signal to be output and passage of more than one stationery item causes said second signal to be output.

Preferably said sensor means is adjustable so that the separation at which said another signal is output may be varied to suit the thickness of the stationery items being handled by the paper handling apparatus.

In one arrangement, one of the rollers is spring-biased into engagement with the other roller and said sensor means includes blanking plate means pivotally coupled to a chassis member of the apparatus and coupled to the axle of said spring-biased roller, and a first fixed sensor disposed in the locus of movement of said blanking plate for generating said first signal and a movable sensor disposed in the locus of movement of said blanking plate and spaced from said first fixed sensor for generating said second signal.

In one arrangement, the paper handling apparatus is a folder inserter apparatus and the two feed rollers are located adjacent the mergence of the paper path followed by a first insert and that followed by a second insert. This arrangement includes a control for controlling movement of inserts downstream of said mergence and the control responds to said one signal to interrupt movement beyond said feed rollers until elapse of a pre-set time or receipt of a predetermined signal.

In one arrangement, the movable sensor is secured to an adjustment arm which is pivotally secured to the same chassis pivot point as the blanking plate, and manually operable adjustment means are provided for adjusting the position of the adjustment arm.

BRIEF DESCRIPTION OF THE DRAWINGS

A non-limiting example of a folder inserter machine will now be described by way of example only, reference being made to the accompanying drawings, in which.

SPECIFIC DESCRIPTION OF A PREFERRED EMBODIMENT

The folder inserter illustrated herein may be used in an automatic mode in which sheets are automatically fed into the machine, folded and inserted into an envelope, or a semi-automatic mode in which the sheets are fed manually into the machine to be folded and inserted into an envelope. In either automatic or semi-automatic mode the machine allows the insertion of documents via a second (manual) insert tray. The machine may also be used in a fold-only mode.

Figure 1:
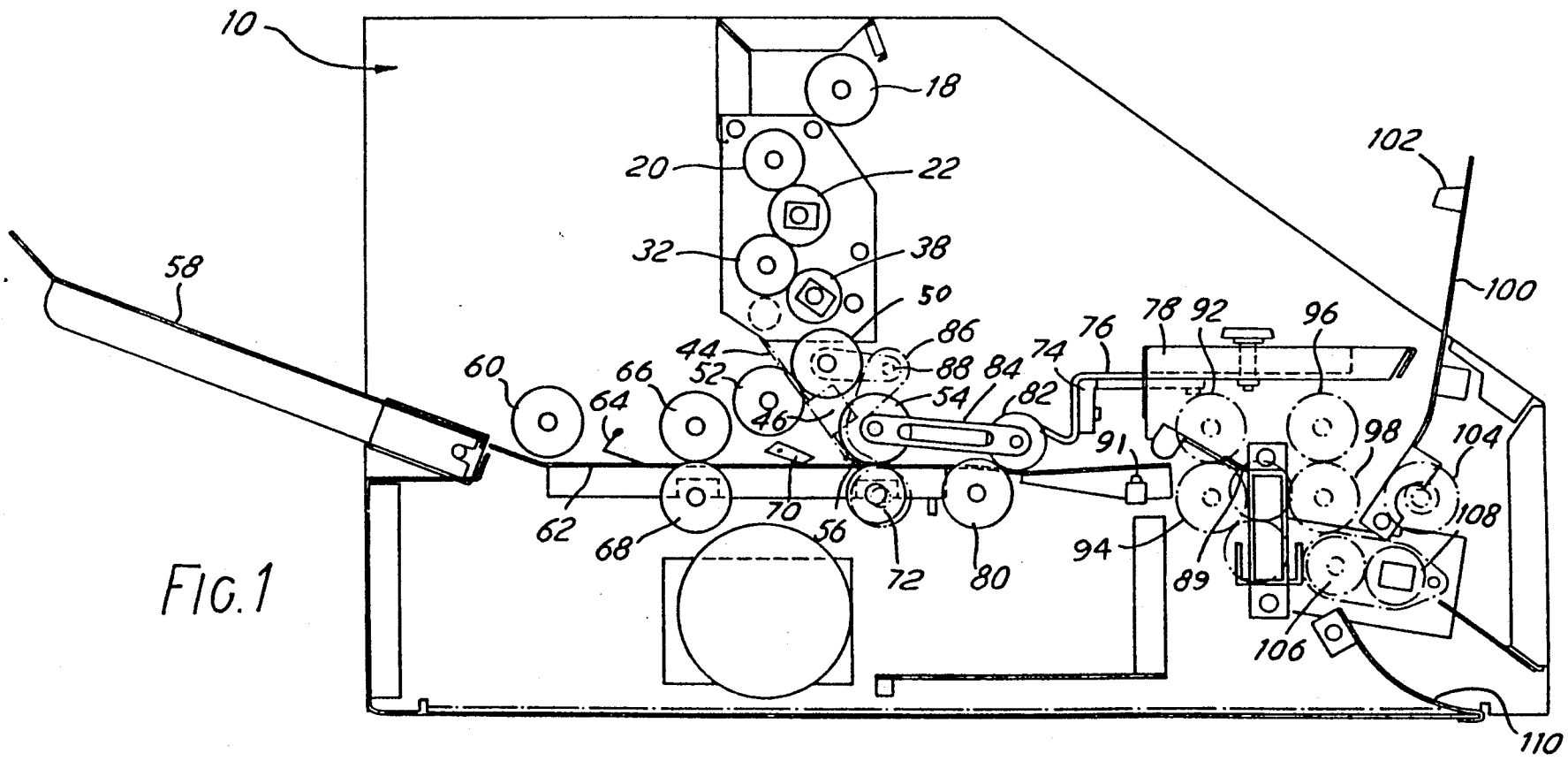
FIG. 1 is a schematic side view of the folder inserter machine with various items removed for clarity, for illustrating the principal feed rolls and the feed paths for the inserts and the envelopes within the machine.
Figure 2:
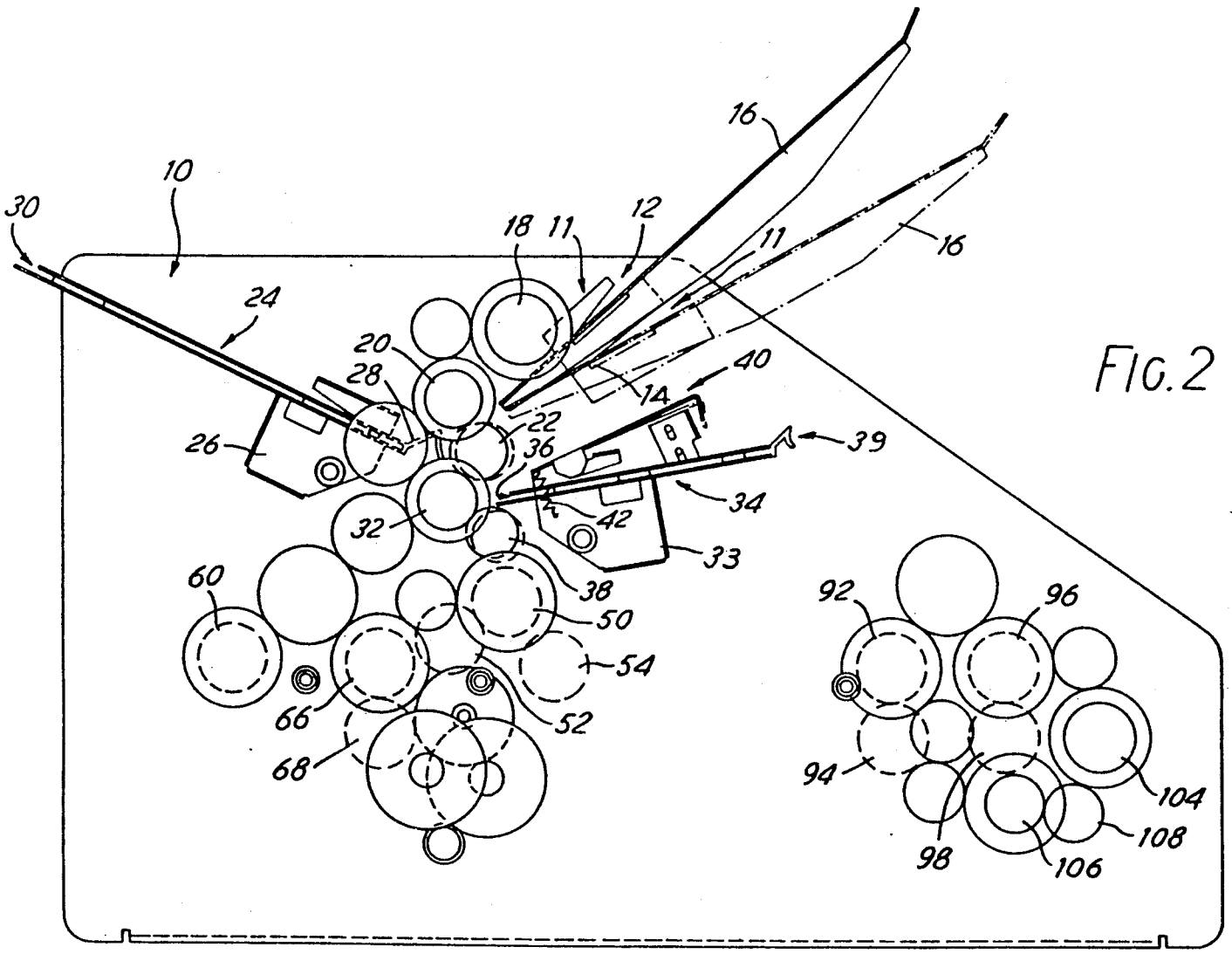
FIG. 2 is a schematic side view similar to that of FIG. 1, but illustrating the principal drive trains, the feed trays for the primary and secondary inserts and the first and second reversible buckle chutes.

Referring to FIGS. 1 and 2, the machine comprises two side chassis members 10 between which are supported the principal drive rollers of the machine. Each chassis member 10 carries a latch plate 11 with separate latch portions 12, 14 for supporting a primary feed tray 16 in a position for automatic feed and semi-automatic feed respectively. When in its automatic feed position (the upper position as viewed in FIG. 2) the primary feed tray 16 is located in the upper position in FIG. 2 in close proximity to a separator roller 18 and co-operates therewith in a known manner to feed sheets stacked on the primary feed tray 16 towards the bite defined between feed rollers 20, 22 in seriatim fashion. The separator is driven via a clutch (not shown) controlled by the machine control (not shown in FIGS. 1 or 2). When the primary feed tray 16 is located in its semi-automatic mode for manual insertion of inserts, (the lower position in FIG. 2) the primary feed tray is spaced from the separator roller 18 and is aligned with the common tangent of the feed rollers 20 and 22. Each latch portion 12, 14 has a microswitch 15, 17 respectively (not shown in FIGS. 1 or 2) associated therewith which senses the presence of the primary feed tray 16 and signals this to the machine control 25 (not shown in FIGS. 1 or 2). Referring to FIG. 2 it will be noted that the feed roller 20 is driven but the feed roller 22 is spring-loaded to engage the driven feed roller 20. After passing between feed rollers 20, 22 an insert is presented to a first reversible buckle chute 24. The buckle chute 24 is removably and reversibly located between two latch plates 26 located one on each side chassis member 10 respectively. As will be discussed in more detail later, the reversible buckle chute 24 may either be located between the latch plates 26 so that it presents a deflector portion 28 to an advancing insert (as shown in FIG. 2) or so that it presents the open end 30 of the buckle chute thereto. Two microswitches 29, 31 (not shown in FIGS. 1 or 2) detect the presence (microswitch 29) and orientation (microswitch 31) of the buckle chute 24 and send appropriate signals to the machine control 25. With the first buckle chute in the position shown in FIG. 2, the leading edge of an insert passing through rollers 20 and 22 will be deflected to pass through the bite defined by rollers 22 and 32, roller 32 being driven. If the buckle chute 24 is reversed the leading edge of the insert will travel through the open end 30 of the buckle chute 24 until it reaches the end or a stop therein, whereupon further feeding of the insert will cause a mid- or trailing portion to buckle and become folded between the bite of the rollers 22 and 32.

After passing the rollers 22 and 32 the insert (in folded or unfolded condition depending upon the position of the first buckle chute 24) is presented to a second reversible buckle chute 34 of similar form to the first buckle chute and being supported between latch plates 33 attached to the chassis members 10. Microswitches 35 and 37 (not shown in FIGS. 1 or 2) sense the presence and orientation of the second buckle chute 34 respectively. In the position shown in FIG. 2, the leading edge of the insert will pass through the open end 36 of the buckle chute 34 until it reaches the stop therein and then buckle to be folded by the bite between feed roller 32 and feed roller 38. If the second buckle chute 34 is inserted the other way around, a primary insert passing between rollers 22 and 32 will be deflected by the deflector portion 39 thereon so that the leading edge of the primary insert (folded or unfolded dependent on the orientation of the first buckle chute 24) is directed to pass into the bite between rollers 32 and 38.

The feed roller 38 is spring-loaded into engagement with feed roller 32 and movement of the feed roller 38 away from engagement with the feed roller 32 is sensed by a double detect and second insert sensing device 41 (not shown in FIGS. 1 or 2) which will be described in more detail below. Briefly, the device 41 outputs to the machine control 25 a first signal when a normal insert is introduced between rollers 32 and 38 and a second signal when two or more inserts are introduced between these rollers. The first sensing action is required when a second insert is to be included as this signal causes the machine control to halt progress of the primary insert through the rollers 32 and 38 until the second insert has been positioned in the leading fold of the primary insert. The second sensing action is required to signal that more than one insert has been fed and to cause the machine control 25 to stop the machine and to signal on the control panel 47 (not shown in FIGS. 1 or 2) that a double insert has occurred.

Above the second buckle chute 34 a second insert tray 40 is pivotally supported on the chassis member 10. The tray 40 assists an operator to insert manually a second insert into the leading fold of a primary insert when the primary insert is stationery and its leading edge gripped between rollers 32 and 38. Briefly, the second insert tray 40 is capable of limited pivotting movement about its leading (i.e. left-hand in FIG. 2) portion, and the tray 40 is biased in the counterclockwise sense by means of a spring 42. A microswitch 43 (not shown in FIGS. 1 or 2) senses deflection of the second insert tray 40, and signals to the machine control 25. The machine control 25 is arranged so that, when the machine is in second insert mode and the primary insert is held between the rollers 32 and 38, release of the second insert tray from its downwardly deflected position signals the machine control 25 to continue drive of rollers 32 and 38 and the remainder of the rollers which drive the insert into the envelope following a short, pre-set delay.

After leaving the rollers 32 and 38, the insert (folded or unfolded, with or without insert) engages a deflector plate 44 (see FIG. 1) pivotally attached to the chassis members 10 at 46. The plate 44 deflects when engaged by the insert and activates a through beam sensor 45 (not shown in FIGS. 1 or 2).

The deflector plate 44 causes the insert to pass into the bite defined by rollers 50 and 52, of which roller 50 is driven. After passing from rollers 50 and 52 the insert is urged into engagement with a drive roller 54 by means of two spaced spring steel fingers 56 located at the lower edge of the deflector plate 44. The description thus far describes how the insert reaches the point where it enters the envelope. The feed path for the envelope to this same point will now be described.

Referring to FIG. 1, an envelope hopper 58 is releasably secured to the chassis by means of a peg and slot arrangement. A separator roller 60 driven via a clutch (not shown) and pre-feed roller (not shown) co-operate with the hopper 58 in known manner to feed the envelopes seriatim from the hopper with their flaps uppermost and trailing. The envelopes pass along a deck 62 past a flapper 64 which ensures that the flap of the envelope is opened. Passage of the envelope past the flapper is detected by a through beam sensor 63 (not shown in FIGS. 1 or 2) associated with the flapper and a signal is supplied to the machine control 25. When the machine is in a folding mode, the machine control 25 causes an insert to be drawn from the primary feed tray 16 by separator roller 18 driven via a clutch mechanism (not shown) and supplied via the rollers 20, 22, 32, 38, 50, 52 to drive roller 54. The train of rollers 20, 22, 32, 38, 50 and 52 are driven directly from the machine motor which is associated with roller 20. The clutch mechanism is actuated in accordance with signals output by the machine control 25. After passing under the flapper 64, the envelope passes between the bite of rollers 66 and 68, of which 66 is driven. Thence the envelope passes beneath a pair of spaced fingers 70 which are pivotally mounted on the chassis and bear on the upper surface of the envelope and maintain the flap of the envelope open whilst the insert is inserted into the envelope. After passing beneath the fingers 70, the envelope passes between drive roller 54 and a driven roller 72. The driven roller 72 is moved out of engagement to halt movement of the envelope by means of the solenoid actuator arrangement 73 of an envelope throat opening and drive mechanism (not shown in FIGS. 1 or 2). The mechanism effects disengagement of the roller 72 at the same time as urging the fingers 70 against the flap of an envelope to ensure that the envelope is held in a fully open position whilst the insert is inserted. Disengagement of the roller 72 and downward urging of the fingers is effected by the machine control 25 when the presence of an envelope is detected by an end of envelope sensor 74 which is attached to an arm 76 adjustably mounted on a structural cross member 78 spanning the chassis members 10. The arm is adjusted for different lengths of envelope so that, in operation of the machine, a given envelope is caused to stop with its throat in the correct position for insertion of the insert (i.e. with the throat of the envelope adjacent or immediately downstream of the contact of the roller 54 and the fingers 56 of the deflector plate 44). Beyond the rollers 72 is a lower roller 80 which is driven from roller 72 by means of an O-ring driven (not shown), and an upper roller 82 which is pivotally secured by means of a pair of links 84 to the shaft of roller 54. Adjacent the lower roller 80 the deck 62 is cranked downwardly and adjacent the upper roller 82 the deck is cranked upwardly so as to be inclined upwardly with respect to the horizontal. The positions of the rollers 54, 72 and the staggered positions of the rollers 80 and 82, together with the profile of the deck 62 in the region serve to flex the envelope so that its front surface is concave and this has been found by the applicants to increase the size of the throat opening of the envelope before insertion of the insert.

The envelope is halted in readiness for the insert (which has been passing along the paper path defined by rollers 20, 22, 32, 38, 50 and 52), with the fingers 70 holding the flap open and the throat opening maximised by the above arrangement. The drive roller 54, in conjunction with the fingers 56 on the lower end of the deflector plate 44 then drives the insert into the envelope.

A pair of insert fingers 86 are adjustably mounted on a shaft 88 which is connected by links 90 to the shaft of roller 50. The fingers 86 bear downwardly under gravity and ensure that, as an insert passes underneath the fingers, the forward outer corners of the insert are urged against the envelope to reduce the possibility of the insert corners snagging the throat of the envelope during insertion.

Once the insert has been inserted into the envelope the deflector plate 44 returns to its rest position and in doing so releases the associated through beam sensor 45 which signals the machine control 25 to re-engage roller 72 and withdraw fingers 70 upwardly to allow unimpeded passage of the next envelope. Also, the deflector plate 44 signals the machine control to cause a wiper plate actuator 87 (not shown in FIGS. 1 or 2) to raise the wiper plate 89 in readiness for the sealing operation. On re-engagement of roller 72 with roller 54, the filled envelope is passed towards the sealing mechanism of the machine. The envelope passes along the inclined portion of the deck and when the fold between the flap and the envelope body passes a microswitch 91 positioned below the deck a signal is sent to the machine control 25 which causes the wiper plate actuator 87 to draw the wiper plate 89 down onto the rear surface of the flap thus moistening the gum on the flap. The envelope, still rearside upwards and flap trailing, after passing microswitch 91 passes between rollers 92 and 94, and 96 and 98 (of which 92 and 96 are driven) to be deflected by an end plate 100 having an adjustable stop 102. After leaving rollers 96 and 98 trailing edge and flap of the envelope fall downwardly to be driven by rollers 98 and 104 downwardly into the bite between rollers 106 and 108 of which roller 106 is driven and roller 108 is spring-biased into engagement with roller 106. It will be understood that the path of the envelope up the end plate 100 and back mean that it enters rollers 98 and 104, and 106 and 108 with the flap end of the envelope leading and thus rollers 98 to 108 effect closure and sealing of the envelope. After leaving rollers 106 and 108 the envelope is discharged from the machine via discharge chute 110.

Having described the basic elements of the folder inserter, the control functions of the inserter and various parts of the machine will be described in more detail.

Figure 3:
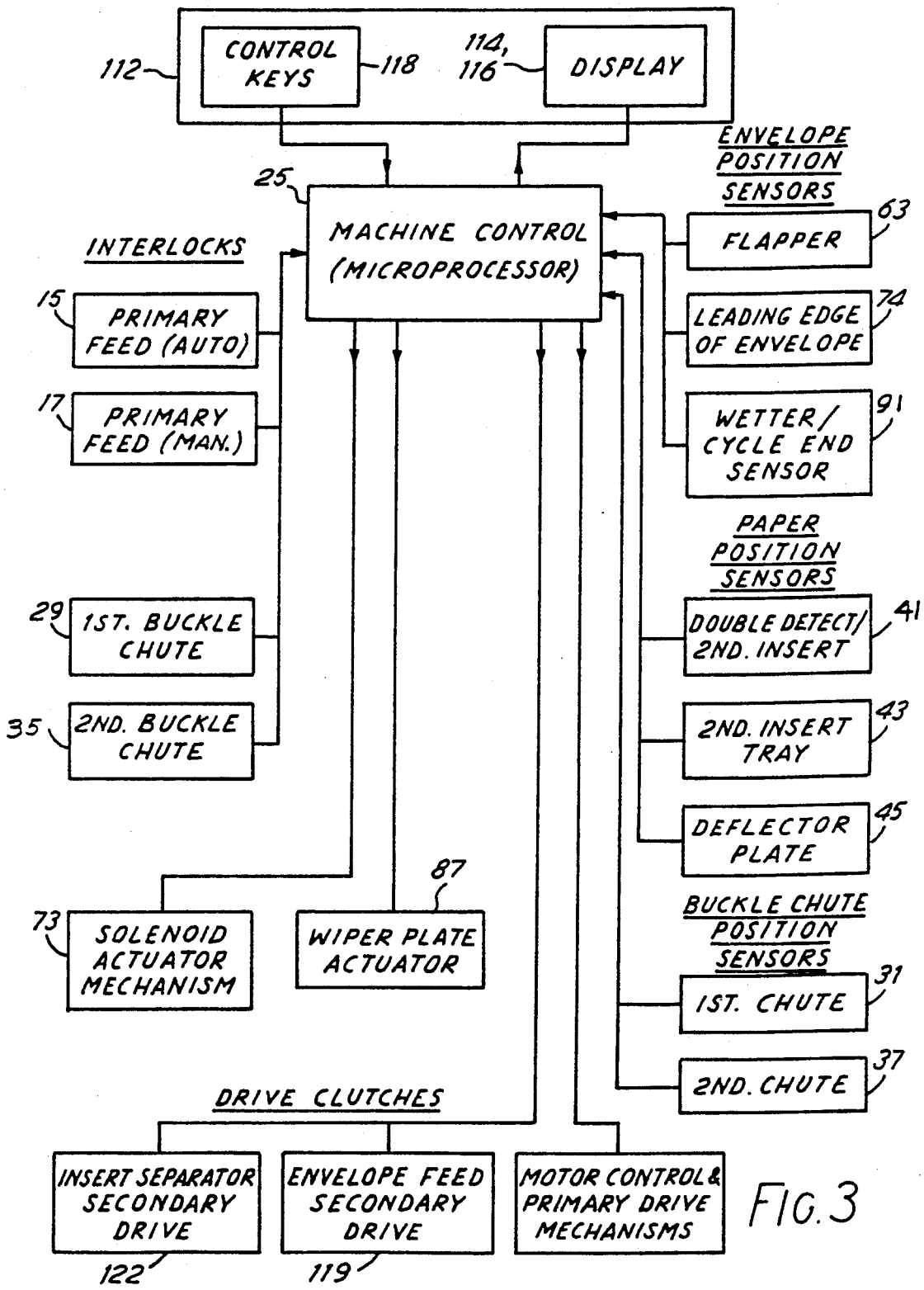
FIG. 3 is a schematic block diagram of the control system for the folder inserter machine of FIGS. 1 and 2.
Figure 4:
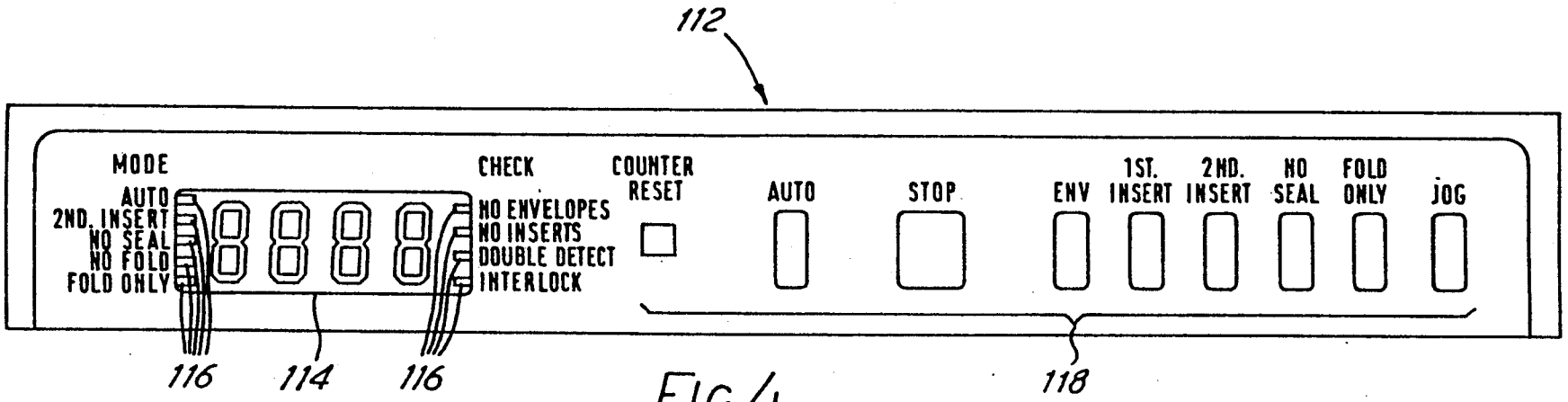
FIG. 4 is a view of the control panel for the folder inserter machine of FIGS. 1 and 2.

Referring to FIG. 3, the machine control 25 is in the form of a microprocessor which controls operation of the machine. Operator commands are entered by means of a control panel 112 (illustrated in detail in FIG. 4) which includes a 4 digit liquid crystal display 114 for displaying a resettable count number of operations completed, and "mode" and "check" annunciators 116 provided at the left and right hand sides of the display respectively. The panel 112 also includes control keys 118 for programming the folder inserter to perform the desired operations.

In "Auto" mode (selected by pressing the "Auto" control button) inserts are fed automatically, seriatim from the primary feed tray 16 and inserted into envelopes fed seriatim from the envelope hopper 58. Each folding and inserting sequence commences with actuation of the envelope feed drive clutch 119 to cause the envelope separator roller 60 to feed an envelope to a position ready for insertion of an insert. The appropriate position is sensed by end of envelope sensor 74 whereupon the machine control 25 de-activates the drive to the envelope by means of the solenoid actuator mechanism 73. The signal from end of envelope sensor 74 also signals the machine control 25 to actuate the wiper plate actuator 87 to lift the wiper plate 89 in preparation for the next envelope. In the folding modes, when an envelope passes the flapper 64 on its way to the insertion position, the microswitch 63 associated therewith signals the machine control which causes the insert separator roller 18 to deliver an insert from the primary feed tray 16 to be folded as necessary by the buckle chutes 24 and 34 and inserted with the envelope. When the insert has been inserted, the microswitch 45 associated with the deflector plate 44 signals to the machine control 25 which reactivates the drive to the filled envelope by means of the solenoid actuator mechanism 73.

The envelope then passes above microswitch 91 which senses the trailing edge of the envelope and signals to the machine control which activates the wiper plate actuator 87 to drop the wiper plate 89 down to moisten the flap of the envelope. The envelope then passes up end plate 100 to perform a three-point turn so that it passes flap-first through the sealing rolls 98, 104, 106 and 108. Passage of the envelope past fold sensor 91 also causes the machine control 25 to initiate the next folding and inserting sequence.

In "2nd Insert" mode (selected by pressing the "2nd Insert" control button), the passage of the first insert is halted by stopping the motor when the insert is in a part-folded state between rollers 32 and 38 as sensed by Double Detect/2nd Insert device 41 and the drive is restarted only when the microswitch 43 associated with the 2nd insert tray 40 has been depressed and released. A pre-set delay is introduced by the machine control between release of the microswitch 43 restarting the motor. The delay may typically be about 1 second. Otherwise the sequence is similar to that of the "Auto" mode.

In "No Seal" mode (selected by pressing the "No Seal" button), the wiper plate actuator 87 drives the wiper plate 89 upwardly out of the path of the envelope so that the flap thereof is not moistened. The envelopes thus leave the folder inserter without having been sealed. Otherwise the sequence is generally similar to "Auto mode".

In "No Fold" mode, it is not necessary to push a control button. Instead, the machine control automatically configures the machine for "No Fold" when both the buckle chute position sensors 31 and 37 signal that the first and second buckle chutes 24 and 34 are both in a no fold position, i.e. with both presenting their deflector plates 28, 39 to an oncoming insert. As well as displaying "No Fold" by means of the appropriate annunciator 116, the machine control also alters the sequence of operation of the insert feed and the envelope feed. In normal fold (single-, double-or U-fold) modes the progress of the insert through the machine is slowed by each folding action. In this mode of operation, actuation of the insert separator drive clutch 122 to feed an insert from the primary feed tray is initiated when the machine control 25 receives a signal from through beam sensor 63 signifying that the envelope has passed under the flapper 64. The time taken for the envelope to pass from the flapper to the position at which the insert is inserted is no longer than the time taken for an insert to pass from the primary feed tray 16, be folded as desired and to reach the insertion position. In the "No Fold" mode however, the insert passes through the machine at a faster speed and thus the machine control 25 does not actuate the insert separator drive clutch 122 until the envelope is in the position ready for insertion of the insert, this position being detected by the end of envelope detector 74. Once the envelope has been filled, the sequence of operations is similar to "Auto" mode.

In the "Fold Only" mode, set by pressing the "Fold Only" control button, the envelope feed rollers 54, 72, 80 and 82) and the wiper plate 89 are deactivated, but otherwise the sequence is generally similar to the "Auto" mode.

It will be understood that the modes listed above are not necessarily mutually exclusive. For example the folder inserter may be operated in "Auto"+"2nd Insert"+"No Seal" modes in combination or "Auto"+'-'No Seal"+"No Fold" modes in combination. It should be noted however that in the "2nd Insert" mode, a fold should be executed at the second buckle chute 34 so that the 2nd insert is received within the fold of the primary insert to assist insertion of the folded inserts into an envelope.

The "Check" or fault annunciators 116 will now be described. The "No Envelopes" annunciator is displayed if the flapper microswitch 63 is not activated within a pre-set delay following start of the cycle. The "No Inserts" annunciator is displayed if the double detect/2nd insert device 41 does not indicate the presence of an insert within a pre-set time after the start of the cycle. The timing, detection and display for the "No Envelopes" and "No Inserts" are controlled by the machine control 25.

The "Double Detect" annunciator is displayed if the double detect/2nd insert device 41 signals a double detect to the machine control.

The "Interlock" annunciator is displayed if one or more of the primary feed tray 16, the first buckle chute 24 and the second buckle chute 34 are not in their, or one of their, correct positions as sensed by interlock microswitches 15, 17, 31, 35 and 37 respectively. As well as displaying the annunciator for "Interlock", the machine control disables the drive to the rollers of the folder inserter for safety reasons.

Depression of the "Jog" button causes the rollers in the machine to be incremented through a set amount, typically 90°. This feature is designed to allow easy release of any jams which might occur in the machine whilst minimising the possibility of injury to the operator arising from clothing or hair getting drawn into the machine.

Depression of the "Stop" control button stops the operation of the machine.

Depression of the "Env" button causes an envelope to be delivered from the envelope hopper 58 to the insert position and, depression of the "1st Insert" button causes a first insert to be delivered to the insert position having ensured that an envelope is in the insert position.

Figure 5:
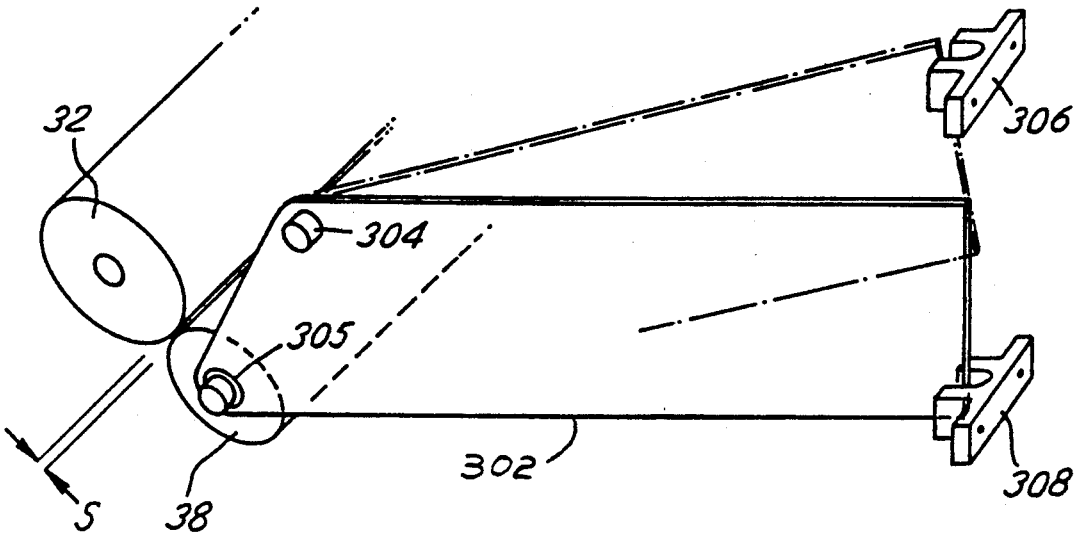
FIG. 5 is a schematic perspective view of the double detect/2nd insert device.
Figure 6:
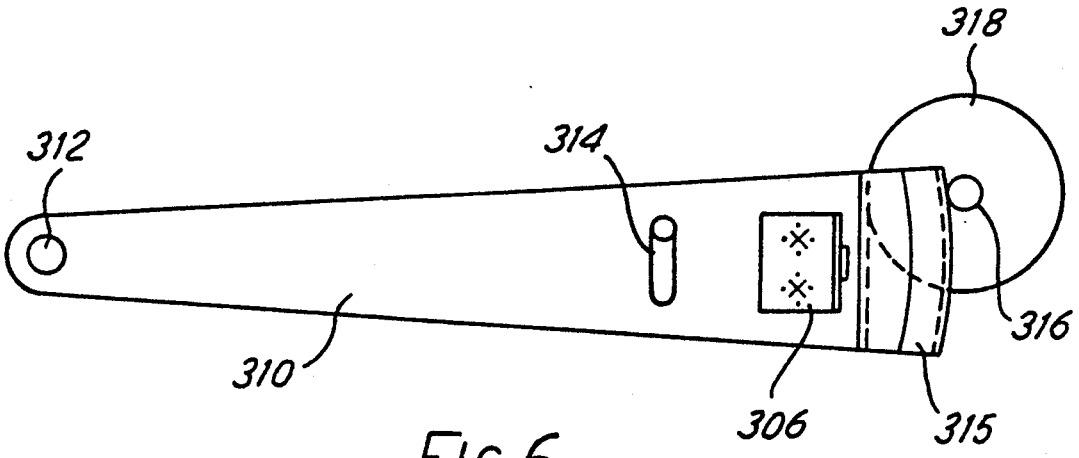
FIG. 6 is a detailed view of the double detect/2nd insert device showing the adjustment arm thereof.

A more detailed description will now be made of the double detect/2nd insert device 39 with particular reference to FIGS. 5 and 6. Referring to FIG. 5, there are shown the driven roller 32 and the movable roller 38 biased into engagement with the roller 32. The insert device includes a blanking plate 302 having a pivot 304 by which the plate is pivotally mounted on a chassis member 10, and a slightly oversize hole 305 which fits around the axle of the movable roller 38. When roller 38 is displaced away from the roller 32, the blanking plate 302 is caused to move counterclockwise by an amount proportional to the separation 's' between the rollers 32 and 38. Two through beam optical detectors are provided; an upper, adjustable optical detector 306 and a lower optical detector 308 which is fixedly mounted on the chassis. The lower optical detector 308 is positioned during manufacture of the folder inserter so that, in use, any insert passing between rollers 32 and 38 causes the blocking plate to move clear of the lower optical detector 308 causing a signal to be sent to the machine control 25. When the folder inserter is in "2nd Insert" mode the signal output by the upper optical detector 306 causes the machine control to de-activate the folding mechanism drive (rollers 20, 22, 32, 38, 50 and 52) by stopping the motor.

The adjustable detector 306 is mounted on one end of an adjustment arm 310 (see FIG. 6) which has a bearing hole 312 at its other end by which it is pivotally mounted on pivot 304 of the blocking plate 302. The arm 310 includes a slot 314 which co-operates with a fixed peg to limit the amount of angular movement of the adjustment arm. The end of the arm adjacent the optical detector 306 is provided with a U-shaped plastics or rubber strip 315 which co-operates with a splined or ribbed shaft 316 rotatably secured to the chassis and which extends through the housing of the folder inserter to carry an adjuster knob 318 located outside the folder inserter. Rotation of the knob drives the arm 310 about the pivot 304 to move the optical detector 306 to the correct position. If an attempt is made to adjust the arm beyond one of its limit positions, the shaft 316 will merely slip against the rubber strip 315.

The arm 310 is adjusted so that the blanking plate 302 is sensed by the detector 306 when a double insert is fed. The signal is supplied to the machine control which inhibits further operation of the machine and displays a "Double Detect" annunciator. In order to adjust the arm 310 to the appropriate position, the operator winds the detector down to its lowest position using the knob 318 and then presses the "1st Insert" control button to feed an insert through. When the insert reaches rollers 32 and 38, the machine will stop because the blanking plate 302 will be detected by the detector 306 as the detector is at such a low setting. The operator then winds the detector up until just after the detector is clear of the blanking plate 302 and the machine will recommence operation. The plate will then be at the correct setting.

This arrangement allows quick, simple and effective setting of the double detection mechanism from outside the machine housing without requiring removal of side panels etc. Also, the operator does not have to see the movable detector 306 to adjust it to the correct position.

What is claimed is:

1. Paper handling apparatus including a paper path, two feed rollers in driving association located on said paper path and movement sensor means for detecting separating movement of said feed rollers, said sensor means being operable to output a first single in response to the presence of a single stationery item between said feed rollers and to output a second signal when more than one stationery item passes between said feed rollers, whereby in use passage of a single item between said feed rollers causes said first signal to be output and passage of more than one stationery item causes said second signal to be output, and wherein said sensor means is adjustable so that the separation at which said second signal is output may be varied to suit the thickness of the stationery items being handled by the paper handling apparatus.

2. Paper handling apparatus according to claim 1 wherein one of the rollers is spring-biased into engagement with the other roller and said sensor means includes blanking plate means pivotally coupled to a chassis member of the apparatus and coupled to the axis of said spring-biased roller, and a first fixed sensor disposed in the locus of movement of said blanking plate for generating said first signal and a movable sensor disposed in the locus of movement of said blanking plate and spaced from said first fixed sensor for generating said second signal.

3. Paper handling apparatus according to claim 1 for use as a folder inserter apparatus which includes a first insert path followed by a first insert and a second insert path followed by a second insert, said second insert path merging with said first insert path and said feed rollers are disposed adjacent the mergence of said first and second insert paths.

4. Paper handling apparatus according to claim 3, which further includes a control means for controlling movement of inserts at least downstream of said mergence, said control means being responsive to said first signal to interrupt movement of said feed rollers until elapse of a pre-set time or receipt of a predetermined signal.

5. A paper handling apparatus according to claim 1 wherein said movable sensor is secured to an adjustment arm which is pivotally secured to the same chassis pivot as the blanking plate and said apparatus includes manually operable adjustment means for adjusting the position of the adjustment arm.

* * * * *